United States Patent [19]

Sema

[11] Patent Number: 4,703,700

[45] Date of Patent: Nov. 3, 1987

[54] HEIGHT ADJUSTABLE DESK

[75] Inventor: Teruji Sema, Tokyo, Japan

[73] Assignee: Inaba Seisakusho Ltd., Tokyo, Japan

[21] Appl. No.: 852,700

[22] Filed: Apr. 16, 1986

[30] Foreign Application Priority Data

Apr. 19, 1985 [JP] Japan ..... 60-57547[U]

[51] Int. Cl.[4] ..... A47F 5/12; A47B 11/00

[52] U.S. Cl. ..... 108/10; 108/138; 108/147

[58] Field of Search ..... 108/10, 9, 7, 6, 2, 108/1, 138, 144, 146, 106, 147; 248/420, 398

[56] References Cited

U.S. PATENT DOCUMENTS

| | | | |
|---|---|---|---|
| Re. 25,376 | 4/1963 | Freeman | 108/10 |
| 1,726,786 | 9/1929 | Whitney | 108/2 X |
| 2,892,486 | 6/1959 | Herring et al. | 248/420 |
| 3,304,892 | 2/1967 | Bengtson | 108/144 X |
| 3,640,228 | 2/1972 | Busse | 108/6 |
| 3,958,659 | 5/1976 | Selman | 108/7 X |
| 4,397,245 | 8/1983 | Nashburn | 108/9 X |
| 4,511,110 | 4/1985 | Möller | 108/147 X |
| 4,566,741 | 1/1986 | Eriksson et al. | 108/147 X |
| 4,590,865 | 5/1986 | Rötsche et al. | 108/147 X |

FOREIGN PATENT DOCUMENTS

| | | | |
|---|---|---|---|
| 311622 | 10/1917 | Fed. Rep. of Germany | 108/9 |
| 1753048 | 7/1971 | Fed. Rep. of Germany | 108/9 |
| 2511626 | 10/1975 | Fed. Rep. of Germany | 108/10 |

*Primary Examiner*—Kenneth J. Dorner
*Assistant Examiner*—José V. Chen
*Attorney, Agent, or Firm*—Frank J. Jordan; C. Bruce Hamburg; Manabu Kanesaka

[57] ABSTRACT

Metal desk with a table top, height of which is adjustable and includes a table top, triangular guide frames movably mounted under the table top, leg stand members slidably supporting the triangular guide frames, and a driving apparatus fitted with the table top and operably connected to the triangular guide frame to move obliquely along an oblique element of the leg stand member. The triangular guide frames are certainly held to the leg stand members to maintain the table top height by a finger screw.

7 Claims, 2 Drawing Figures

HEIGHT ADJUSTABLE DESK

BACKGROUND OF THE INVENTION

This invention relates to a metal desk, and more particularly to a metal desk, wherein the height of a table top can be changed and the table top can be locked at an appropriate table top height.

In a conventional metal desk, wherein the height of a table top is adjustable, a driving apparatus which moves upward or downward the table top by a screw or a cylinder is vertically provided with a side plate or a pedestal which supports the table top. And, a finger screw is used to lock the table top at an appropriate height due to screw fastening. An operation of vertical movement of the table top is made around the pedestal away from the table top, and the operation becomes complicate, and still more the table top is unstable and shaky on the pedestals. Therefore, durability of the metal desk reduces and it becomes expensive. In addition, since the lock of the table top at the proper height is due to the finger screw, a threaded screw is defaced by use during long time, and locking effect of the table top becomes insufficient.

SUMMARY OF THE INVENTION

The present invention provides a new and more efficient metal desk. The metal desk of the present invention includes a table top which has a pair of side base plates thereunder, a pair of leg stands, and at least one driving apparatus which is disposed to the side base plate and is operably connected to the leg stand. The leg stand comprises a leg stand member which has an oblique sleeve member, and a triangular guide frame which is slidably disposed to the leg stand member. The triangular guide frame comprises an oblique member, a horizontal member extended from a top end of the oblique member, and a supporting member disposed triangularly between the oblique member and the horizontal member. The oblique member of the triangular guide frame which has a plurality of rollers is slidably inserted in the oblique sleeve of the leg stand member. The table top is supported on the horizontal member of the triangular guide frame and is linked to the leg stand member by a supporting member with a pivotal pin. A lock apparatus of a finger screw is applied to the leg stand member to hold the triangular guide frame at the proper height of the table top.

When the table top is moved upward, the driving apparatus provided on the side base plate is operated to push the horizontal member of the triangular guide frame. Accordingly the triangular guide frame moves obliquely upward along the oblique sleeve of the leg stand member, and the table top is smoothly moved substantially upward along a vertical arc of the pivotal pin within a limited range in accordance with movement of the triangular guide frame.

The driving apparatus does not return automatically without heavy weighting on the table top. Therefore, the table top maintains its height as it is. But, the lock apparatus is applied in order to lock the triangular guide frame and to prevent unexpected downward movement of the table top, namely the finger screw is fastened to the oblique member.

When the table top is moved downward, the lock apparatus is released and the driving apparatus is operated to move back, namely, the horizontal member of the triangular guide frame is drawn to the front direction, and the triangular guide frame is moved back obliquely along the oblique sleeve of the leg stand and the table top supported on the triangular guide frame is moved down.

Accordingly, an object of the present invention is to overcome the above disadvantages of the conventional table by providing triangular guide frames to leg stands, and a driving apparatus to a table top and operably connecting to the triangular guide frame.

Another object of the present invention is to provide a metal desk, wherein the height of a table top is adjustable by one driving apparatus.

A still another object is to provide a metal desk to maintain a table top at a proper height by a lock apparatus of a finger screw.

A further object of the present invention is to provide a metal desk which has a simple construction and is easily operated to adjust the height of a table top.

A further object of the present invention is to provide a metal desk with a stably mounted table top which has simple constructions and is easily operated to adjust the height of the table top, and is manufactured at a low cost.

A still further object and many of the attendant advantages of the present invention will be readily appreciated as the same becomes better understood by reference to the following description when read in conjunction with the accompanying drawings.

BRIEF DESCRIPTION OF THE DRAWINGS

The accompanying drawings illustrate the preferred embodiment of the present invention.

Figure 1:
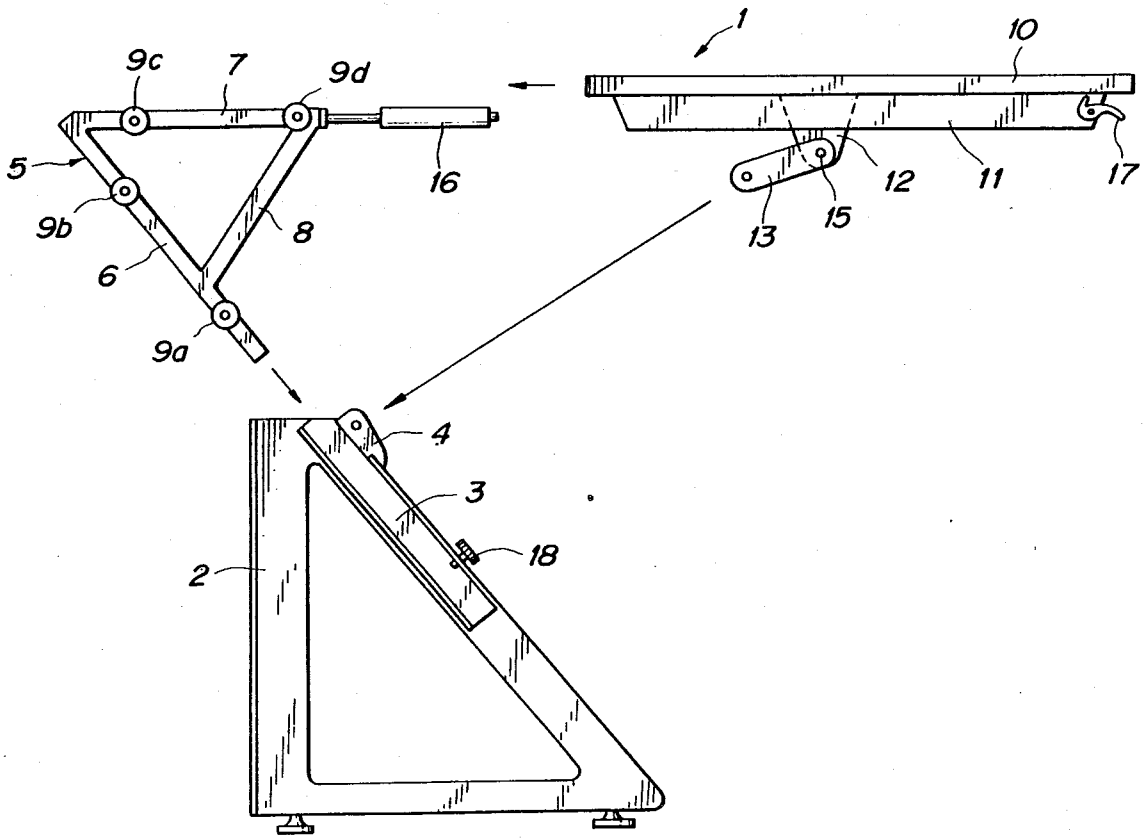
FIG. 1 is a partially cut exploded side view of a metal desk in accordance with an embodiment of the present invention.
Figure 2:
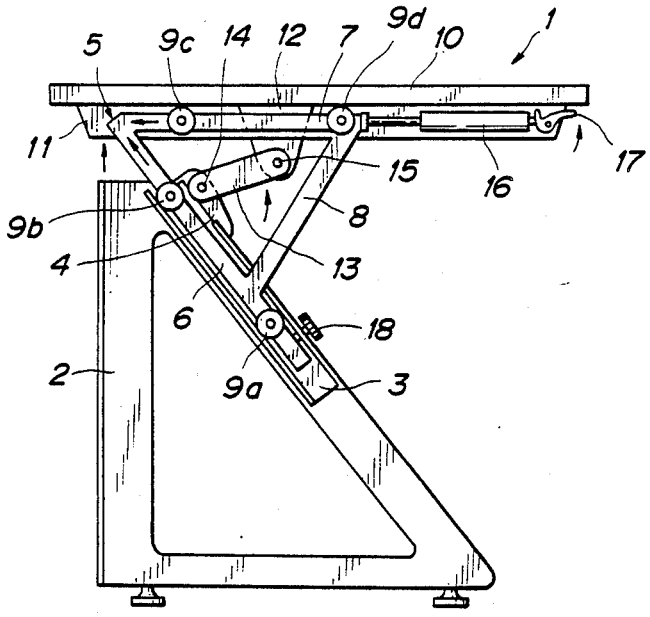
FIG. 2 is a side view of the metal desk showing a condition of upward movement of a table top of the desk.

Referring to the drawings, there is shown, according to a preferred embodiment of the invention, in FIGS. 1 and 2, a leg stand member 2 of a metal desk 1 is formed to a right-angled triangle by a metal frame material with a central hollow. A pair of the leg stand members 2 are vertically disposed under both sides of a table top 10 as set of right and left coupled members. In this case, the both side leg stand members 2 are spaced, and are connected at an upper end portion by a level connection in a condition that a predetermined spaced is kept which is not shown in the drawings.

An oblique sleeve member 3 which is a square in a cross sectional view and has a longitudinal opening at an upper central portion disposed parallel to and fixed in an oblique element of the leg stand member at the same angle. In the oblique sleeve member 3, an oblique member 6 of a triangle guide frame 5 is disposed movably upward and downward with rollers 9*a*, 9*b*. The guide frame 5 is triangularly constructed by the oblique member 6, a horizontal member 7 extended horizontally from a top of the oblique member 6, and a supporting member 8 which is disposed triangularly between the oblique member 6 and the horizontal member 7 as shown in the drawings. And, the oblique member 6 is formed to have a width to be received in the oblique sleeve member 3. The supporting member 8 has a width to slide in the longitudinal opening of the oblique sleeve member 3. Rollers 9*a*, 9*b*, 9*c* and 9*d* are disposed on the oblique member 6 and the horizontal member 7.

The table top 10 is mounted on the horizontal member 7 of the triangular guide frame 5 through the rollers of the horizontal member 7. A pair of side base plates 11 which are smaller than the table top 10 are fixed on a bottom of the table top 10. A supporting projection 12 which has a hole is mounted at an inside of an intermediate portion of the side base plate 11, and an upper end of a supporting member 13 which has a hole is pivotally mounted on the supporting projection 12 by a pivotal pin 15 which is inserted in the aligned both holes thereof. A lower end of the supporting member 13 which has a hole is pivotally mounted on a supporting member 4 which has a hole and is connected at an upper portion of the leg stand member 2, by a pivotal pin 14 as a same manner of the upper end pivotal connection thereof.

When the table top 10 which is mounted on the triangular guide frame 5 moves upward, the table top 10 does not rise obliquely in a straight line along the oblique movement of the triangular guide frame 5, and rises substantially just above as it is, because the table top 10 is pivotally connected to the leg stand member 2 by the supporting member 13.

A driving apparatus 16 is constructed by a gas-spring device or the like. In a cylinder of the apparatus the compressed gas or liquid gas is put in, and a piston goes ahead due to the pressure of the gas. A piston rod which is connected to the piston and is moved by the piston transfers pressure of the piston to the triangular guide frame 5. The driving apparatus 16 is installed horizontally parallel to the side base plate 11 at a front side portion thereof, and the piston rod is connected to an end of the horizontal member 7 of the triangular guide frame 5. Accordingly, when the driving apparatus 16 is operated, the triangular guide frame 5 moves obliquely along the oblique sleeve member 3 for the appropriate distance and simultaneously the table top 10 rises just above.

A hand lever 17 is operably attached to an end of the driving apparatus 16 to operate the driving apparatus in accordance with pushing up of the hand lever by a finger. An interlocking axis which has pinions at both ends is transversely disposed between the both triangular guide frames, namely between the both side plates 11 under the table top 10 not shown in the drawings, and a rack device is formed on an upper surface of each horizontal member 7 of the triangular guide frame 5 not shown in the drawing. By engagement of the pinions and the rack devices, the triangular guide frames 5 at both sides of the table top 10 are simultaneously moved by one driving apparatus 16.

Generally the driving apparatus 16 does not return to a first condition and remains as it is unless strong opposite force is added to the driving apparatus. Therefore, the table top 10 does not fall unless very heavy weights are mounted thereon.

A finger screw 18 is disposed on the oblique sleeve member 3 to certainly fasten the oblique member 6 therein to maintain the appropriate table top height.

A longitudinal cover which is not shown in the drawings is spacedly disposed beside each side base plate 11 to cover the horizontal member 7 of the triangular guide frame 5 and the driving apparatus 16.

With regard to the operation of the metal desk of the present invention, firstly, the finger screw 18 is released from the oblique member 6 of the triangular guide frame 5. Secondly, the hand lever 17 of the driving apparatus 16 is pushed up to operate the driving apparatus 16. By this operation, the piston in the cylinder of the driving apparatus 16 is pushed forwardly due to the compressed gas. Along the forward movement of the piston, the piston rod which is connected to the horizontal member 7 of the triangular guide frame 5 is pushed rearward under the table top 10. At this time, the triangular guide frame 5 is obliquely and upward moved with the rollers along the oblique sleeve member 3, and simultaneously the table top 10 rises vertically operably with the support member 13 in accordance with the obliquely table top 10 reaches to an appropriate height, the hand lever 17 is released and the operation of the driving apparatus 16 is stopped. At this time, in the embodiment the finger screw 18 is fastened to the oblique member 6 through the oblique sleeve member 3.

When the table top 10 is moved downwardly, the finger screw 18 is turned to release the oblique member 6 with the oblique sleeve member 3. And, the hand lever 17 is push up and the driving apparatus 16 is released, and simultaneously the table top 10 is pushed down to an appropriate table top height in opposition to the compressed gas in the cylinder of the driving apparatus 16. When the table top 10 is in the lowest portion, it is not necessary to fasten the oblique member 6 to the oblique sleeve member 3.

In the metal desk of the present invention, it is possible to dispose each driving apparatus 16 on each side base plate of the table top and to connected it respectively to each triangular guide frame disposed to the each leg stand member.

As explained above, the metal desk of the present invention has a pair of uniquely formed triangular guide frames and fastening apparatus of the triangular guide frame. And the triangular guide frame is connected to at least one driving apparatus which is used to change the table top height. Therefore, the table top moves stably upward and downward at the slight force. And the triangular guide frame has a plurality of rollers which effect to smoothly move in the oblique sleeve member and under the table top, therefore, it is possible not to damage the oblique member of the triangular guide frame. The table top height is certainly maintained by the finger screw. The driving apparatus is used for the purpose of the adjustment of the height of the table top, therefore, the metal desk of the present invention can be manufactured at low cost, and the stability and quality of the metal desk is increased.

The invention may be embodied in other specific forms without departing from its spirit or essential characteristics. The described embodiment is to be considered in all respects only as illustrative and not limiting, and the scope of the invention is, therefore, indicated by the appendant claims rather than by the foregoing description. All changes which come within the meaning and range of equivalency of the claims are to be considered within their scope. Consequently, it is recognized that many variations may be made without departing from the scope or spirit of the present invention.

I claim:

1. A height adjustable desk comprising:

a stand device adapted to be situated on a floor and having at least one sleeve member attached to the stand device to extend obliquely upwardly, at least one guide frame including an oblique member slidably situated in the sleeve member and having an upper portion, and a horizontal member connected to the upper portion of the oblique member, a table top slidably situated on the horizontal member of the guide frame, at least one driving apparatus connected between the table top and the horizontal member of the guide frame, said driving apparatus having a switch so that when the switch is actuated, the driving apparatus pushes the horizontal member horizontally relative to the table top, and at least one connecting device situated between the table top and the stand device so that when the driving apparatus is actuated, the guide frame is moved obliquely upwardly along the sleeve member, and the table top is moved substantially vertically upwardly relative to the stand device while laterally sliding on the horizontal member at the guide frame as the guide frame moves obliquely.

2. A height adjustable desk according to claim 1, in which said connecting device comprises an upper supporting projection provided beneath the table top, a lower supporting projection provided on the stand device, and a link pivotally connected to the upper and lower supporting projections.

3. A height adjustable desk according to claim 2, further comprising a fastening device for locking the oblique member relative to the stand device to securely connect the oblique member to the stand device.

4. A height adjustable desk according to claim 2, in which said fastening device is a finger screw mounted on the sleeve member.

5. A height adjustable desk according to claim 2, in which said guide frame further includes a plurality of rollers mounted on the oblique member and the horizontal member so that the oblique member and the horizontal member can smoothly slide relative to the sleeve member an the table top.

6. A height adjustable desk according to claim 5, in which said driving apparatus includes a body connected to the table top, a rod slidably situated in the body and connected to the horizontal member, and means for urging the rod away from the body situated in the body, said rod being urged in the direction away from the body by the urging means only when the switch is actuated.

7. A height adjustable desk according to claim 6, in which said stand device comprises two leg stand members having the sleeve members respectively, said guide frame being provided on each sleeve so that the table top is supported by the two guide frames.

* * * * *